US008662920B2

(12) United States Patent
Ishibashi et al.

(10) Patent No.: US 8,662,920 B2
(45) Date of Patent: Mar. 4, 2014

(54) DEVICE CONNECTOR AND DEVICE CONNECTOR SYSTEM

(75) Inventors: Takeshi Ishibashi, Yokkaichi (JP); Akihito Maegawa, Yokkaichi (JP); Satoshi Tsuruta, Yokkaichi (JP); Yasushi Okayasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/571,436

(22) Filed: Aug. 10, 2012

(65) Prior Publication Data

US 2013/0059466 A1 Mar. 7, 2013

(30) Foreign Application Priority Data

Sep. 5, 2011 (JP) ..... 2011-192586

(51) Int. Cl.
*H01R 13/73* (2006.01)

(52) U.S. Cl.
USPC ..... 439/564; 439/573

(58) Field of Classification Search
USPC ..... 439/573, 544, 562, 564, 571
See application file for complete search history.

(56) References Cited

U.S. PATENT DOCUMENTS

| | | | | |
|---|---|---|---|---|
| 3,740,981 | A | 6/1973 | Patriquin | |
| 6,280,208 | B1 * | 8/2001 | Masuda et al. | 439/98 |
| 6,419,521 | B2 * | 7/2002 | Kanagawa et al. | 439/582 |
| 6,464,538 | B2 * | 10/2002 | Miyazaki et al. | 439/607.44 |
| 6,583,352 | B2 * | 6/2003 | Fukushima et al. | 174/373 |
| 6,695,632 | B2 * | 2/2004 | Matsumoto et al. | 439/246 |
| 6,796,838 | B2 * | 9/2004 | Yoshioka | 439/607.01 |
| 7,094,098 | B2 * | 8/2006 | Miyazaki | 439/559 |
| 7,393,218 | B1 * | 7/2008 | Pavlovic et al. | 439/97 |
| 7,494,374 | B2 * | 2/2009 | Hall et al. | 439/564 |
| 7,614,910 | B2 * | 11/2009 | Croteau et al. | 439/573 |
| 7,731,532 | B2 * | 6/2010 | Masumoto et al. | 439/607.1 |
| 7,811,116 | B2 * | 10/2010 | Sakakura et al. | 439/364 |
| 7,988,475 | B2 * | 8/2011 | Sakakura | 439/271 |
| 8,011,977 | B2 * | 9/2011 | Tsuruta et al. | 439/752 |
| 8,152,574 | B2 * | 4/2012 | Matsuoka et al. | 439/801 |
| 8,167,653 | B2 * | 5/2012 | Hasegawa et al. | 439/607.41 |
| 8,177,584 | B2 * | 5/2012 | Matsuoka | 439/587 |
| 8,241,062 | B2 * | 8/2012 | Tsuruta | 439/589 |
| 8,257,107 | B2 * | 9/2012 | Tsuruta et al. | 439/362 |
| 8,342,880 | B2 * | 1/2013 | Kato et al. | 439/595 |

(Continued)

FOREIGN PATENT DOCUMENTS

| | | |
|---|---|---|
| JP | 8-111217 | 4/1996 |
| JP | 2011-86461 | 4/2011 |

*Primary Examiner* — Ross Gushi

(74) *Attorney, Agent, or Firm* — Gerald E. Hespos; Michael J. Porco; Matthew T. Hespos

(57) ABSTRACT

A male connector (10) is mounted to a case (C) of a device and includes a bolt (B) with a tightening portion (B1) to be engaged by a tool for screwing the bolt into a bolt hole (C2). A shield (20) includes an insertion hole (22) for receiving the bolt (B) and a bolt cap (40) covers the tightening portion (B1). A seat (21) is provided adjacent the insertion hole (22) and is sandwiched by an edge of the bolt hole (C2) and the tightening portion (B1) in the axial direction. A flange (B12) projects out from the tightening portion (B1). A mounting recess (D) is formed between the flange (B12) and the seat (21). A mounting portion (42) is mounted in the mounting recess (D) and engages the bolt cap (40) to hold the bolt cap (40) on the tightening portion (B1).

15 Claims, 9 Drawing Sheets

(56) References Cited

U.S. PATENT DOCUMENTS

| | | | | |
|---|---|---|---|---|
| 8,449,323 | B2 * | 5/2013 | Omae et al. | 439/559 |
| 8,485,844 | B2 * | 7/2013 | Omae et al. | 439/559 |
| 8,545,265 | B2 * | 10/2013 | Sakamoto et al. | 439/606 |
| 8,556,660 | B2 * | 10/2013 | Matsuoka et al. | 439/626 |
| 2002/0127909 | A1 * | 9/2002 | Pradier et al. | 439/573 |
| 2004/0018772 | A1 * | 1/2004 | Zhang et al. | 439/607 |
| 2004/0106325 | A1 * | 6/2004 | Miyazaki | 439/607 |
| 2007/0207652 | A1 * | 9/2007 | Tsuruta | 439/166 |
| 2009/0130898 | A1 * | 5/2009 | Croteau et al. | 439/571 |
| 2010/0173520 | A1 * | 7/2010 | Weidner | 439/564 |
| 2010/0261363 | A1 * | 10/2010 | Sakakura | 439/271 |
| 2011/0014822 | A1 * | 1/2011 | Kato et al. | 439/733.1 |
| 2011/0045684 | A1 | 2/2011 | Morino et al. | |
| 2011/0053403 | A1 * | 3/2011 | Tsuruta et al. | 439/345 |
| 2011/0053404 | A1 * | 3/2011 | Tsuruta et al. | 439/345 |
| 2011/0053408 | A1 * | 3/2011 | Tsuruta et al. | 439/362 |
| 2011/0053434 | A1 | 3/2011 | Seng et al. | |
| 2011/0117784 | A1 * | 5/2011 | Matsuoka et al. | 439/626 |
| 2012/0142214 | A1 * | 6/2012 | Kawamura | 439/571 |
| 2012/0149226 | A1 * | 6/2012 | Ishibashi | 439/271 |
| 2013/0017720 | A1 * | 1/2013 | Maegawa | 439/595 |
| 2013/0059466 | A1 * | 3/2013 | Ishibashi et al. | 439/533 |

* cited by examiner

DEVICE CONNECTOR AND DEVICE CONNECTOR SYSTEM

BACKGROUND OF THE INVENTION

1. Field of the Invention

The invention relates to a device connector to be mounted and fixed to a device and to a device connector system.

2. Description of the Related Art

Japanese Unexamined Patent Publication No. H08-111217 discloses a bolt cap for protecting a tightening portion of a bolt. This bolt cap collectively covers a stud bolt standing on a battery, a terminal fitting connected to the stud bolt and a fastening nut threadedly engaged with the stud bolt. The terminal fitting has a connecting portion with a circular hole that can receive the stud bolt and a crimping portion extending laterally from the connecting portion for crimped connection to a wire. The bolt cap extends laterally in conformity with the shape of the terminal fitting and covers the entire terminal fitting. As a result, the bolt cap and the terminal fitting come into contact in a turning direction about the tightening portion of the bolt to prevent rotation of the bolt cap. A mounting recess for mounting the bolt cap is formed separately from the stud bolt and the bolt cap in the above bolt cap, thereby increasing the number of parts.

The invention was completed in view of the above situation and an object thereof is to enable a bolt cap to be held without increasing the number of parts.

SUMMARY OF THE INVENTION

The invention relates to a device connector to be mounted and fixed to a device by a bolt. The bolt has a tightening portion that can be tightened using a tool to screw the bolt axially into a bolt hole in the device. The device connector includes a connector main body with an insertion hole for receiving the bolt. The device connector also includes a bolt cap to be mounted to cover the tightening portion of the bolt. A seat is provided at a part of the connector main body adjacent the insertion hole to be sandwiched by an edge of the bolt hole and the tightening portion of the bolt. A mounting recess is formed between the seat and a bolt flange that projects from an outer peripheral side surface of the tightening portion of the bolt in a direction crossing the axial direction. A mounting portion is mounted in the mounting recess and engages the bolt cap in the axial direction to hold the bolt cap in a state at least partly covering the tightening portion of the bolt. Thus, the two connectors will not be separated by turning the tightening portion with a tool. Additionally, the mounting recess is between the seat and the bolt flange. As a result, there is no need to form the mounting recess separately from the bolt and the bolt cap so that the bolt cap can be held without increasing the number of parts.

The bolt cap and the mounting portion preferably are connected by at least one flexible hinge. Thus, there is no possibility of losing the bolt cap The bolt preferably is supported rotatably in the seat by mounting a holder, particularly comprising a C-ring, on a shaft inserted through the insertion hole.

The connector main body preferably has a housing made of resin and a shield shell made of a conductive material substantially covers the housing. The seat is provided on the shield shell.

The mounting portion preferably includes at least one engaging portion and the seat includes at least one engageable portion engaged with the engaging portion to prevent rotation of the mounting portion.

A resilient member may be mounted on the outer peripheral surface of the connector main body for closely contacting the connector main body and a portion of a mating connector when the device connector is connected properly to the mating connector. Thus, fluid-tight sealing is provided between the connector main body and a housing of the mating connector.

The invention also relates to a device connection system comprising the above-described device connector to be mounted and fixed to a device, and a bolt including a tightening portion to be tightened using a tool to screw the bolt into a bolt hole in the device in an axial direction of the bolt hole.

The bolt may be supported rotatably in the seat by mounting a holding member, such as C-ring, on a shaft inserted through the insertion hole. Thus, the shaft of the bolt may be inserted into the insertion hole and the C-ring or other holding member may be mounted on the shaft of the bolt.

The connector main body may include a housing made of resin and a shield shell made of a conductive material, such as metal covers the housing. The seat may be provided on the shield shell. According to such a configuration, the shield shell can be shield-connected to the device by tightening the bolt with the shield shell held in contact with the device.

The mounting portion may include an engaging portion and the seat may include an engageable portion that is engaged with the engaging portion to prevent rotation of the mounting portion. According to such a configuration, engaging the engaging portion of the mounting portion with the engageable portion of the seat prevents rotation of the mounting portion relative to the seat.

The tightening portion may comprise a head, a flange connected at a shaft side of the head and a small diameter portion connected at the shaft side of the flange. The flange may have a diameter larger than the head and the small diameter portion.

The head may be a column with a substantially right hexagonal cross-section and the bolt flange and the small diameter portion may both have circular cross-sections.

A clearance may be set between a front surface of the bolt flange and a rear surface of the seat. The mounting recess may be formed by a surface of the clearance.

These and other objects, features and advantages of the invention will become more apparent upon reading of the following detailed description of preferred embodiments and accompanying drawings.

DETAILED DESCRIPTION OF THE PREFERRED EMBODIMENTS

Figure 3:
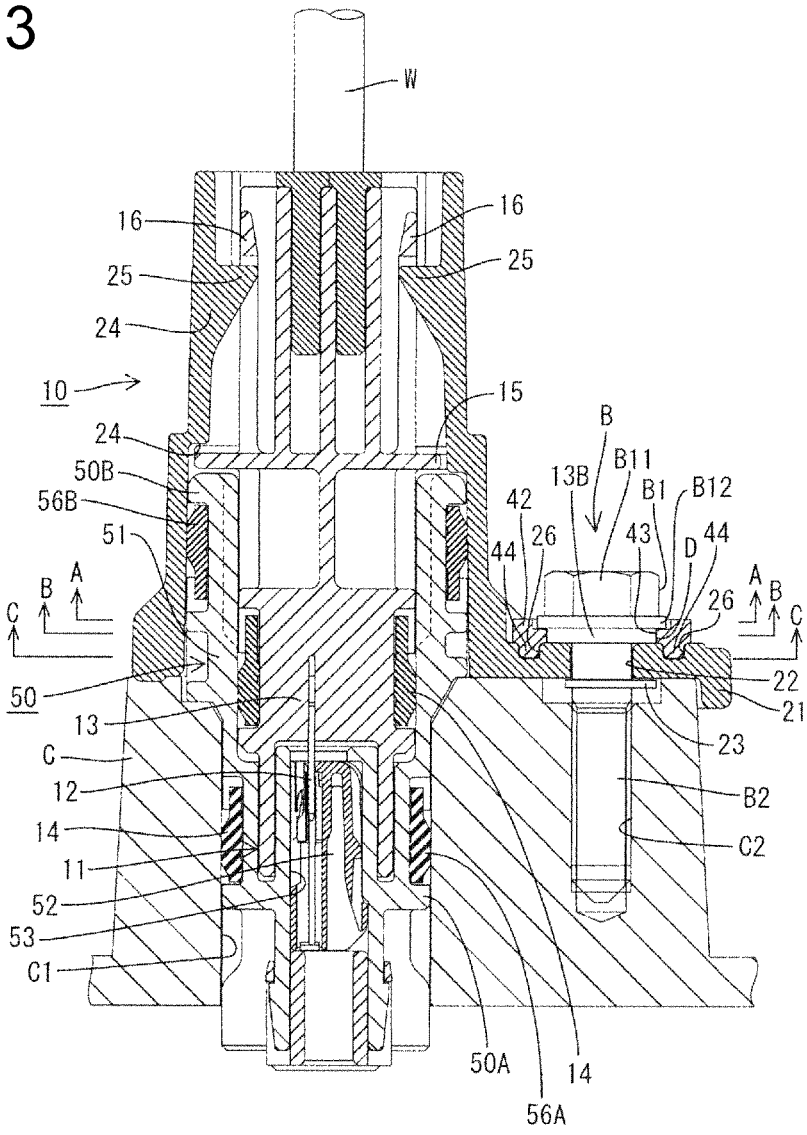
FIG. 3 is a section showing the male and female connectors connected.

A male connector 10 according to the preferred embodiment is connectable to a female connector 50 fixed to a case C of a device by tightening a bolt B into the case C of the device as shown in FIG. 3. In this embodiment, a two-pole male connector 10 and female connector 50 are illustrated. However, the invention also is also applicable to any other type of connector, such as a one-pole connector, a plural-pole connector, a male connector or a female connector. In the following description, forward and backward directions FBD are based on a connecting direction CD of the two connectors 10, 50 and ends of the connectors 10, 50 to be connected are referred to as front ends. Further, an "axial direction" AD of the invention corresponds to forward and backward directions FBD.

The case C of the device is made of an electrically conductive metal. A mounting hole C1 is provided in the case C of the device, and the female connector 50 is to be fit into this mounting hole C1. Two holes are provided in the case C of the device at a peripheral edge of the mounting hole C1. Specifically, one hole is a fixing hole (not shown) that receives a fixing bolt (not shown) for fixing the female connector 50 to the case C of the device, and the other hole is a bolt hole C2 into which the bolt B is screwed to connect the male connector 10 and the female connector 50.

Figure 1:
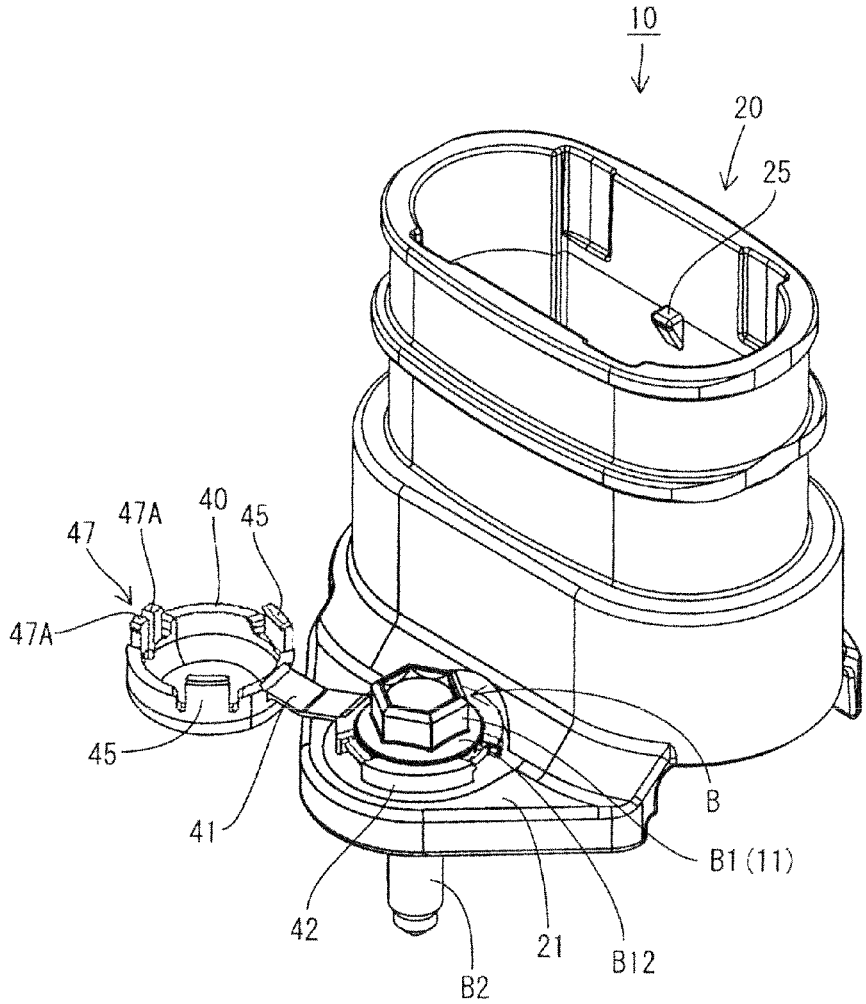
FIG. 1 is a perspective view of a male connector.
Figure 2:
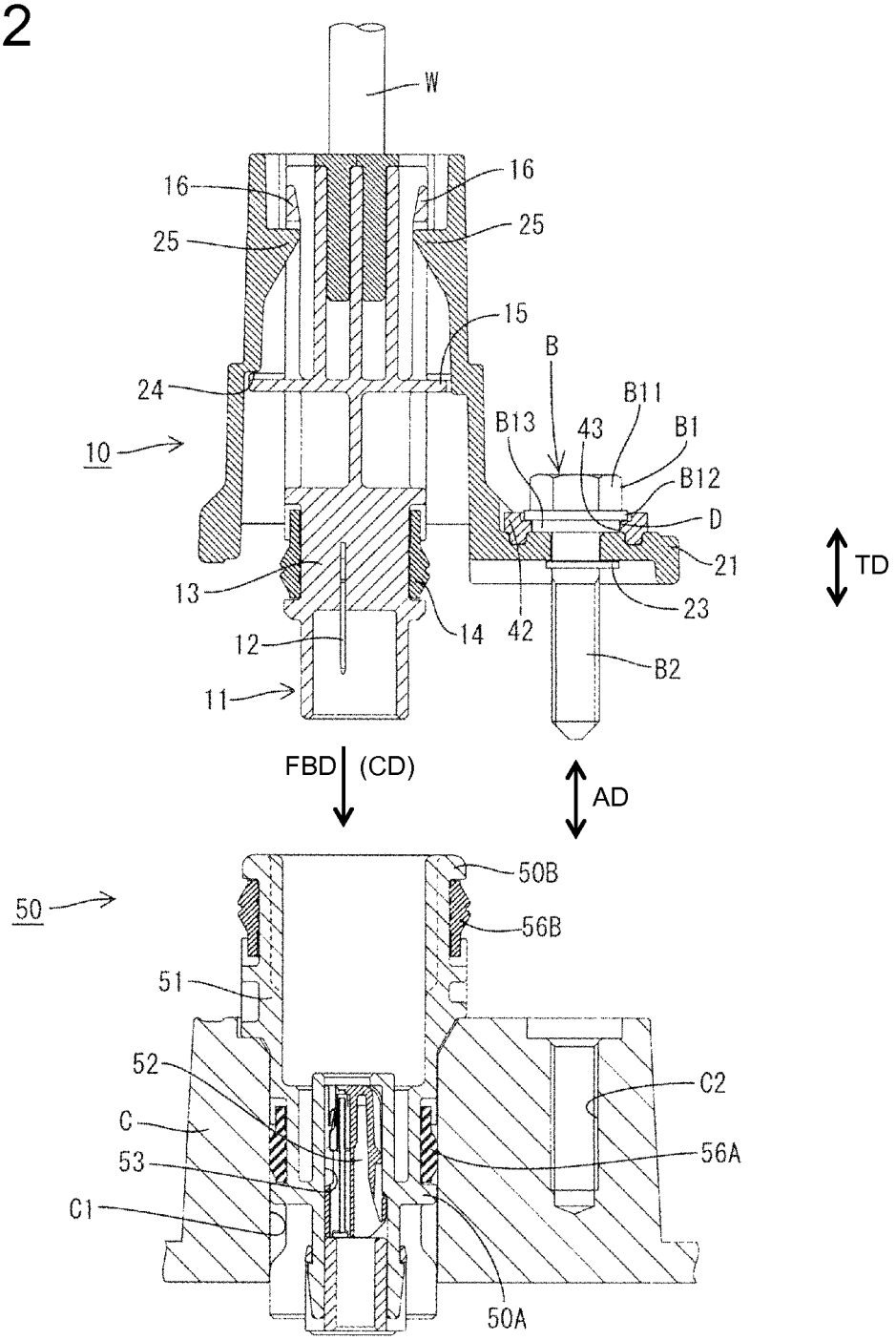
FIG. 2 is a section showing a state before the male connector and a female connector are connected.

As shown in FIG. 2, the female connector 50 includes a female housing 51 made e.g. of synthetic resin and rectangular tubular female terminals 52 are accommodated in the female connector 51. The female terminals 52 are to be connected to an inner wiring (not shown) of the device.

Figure 4:
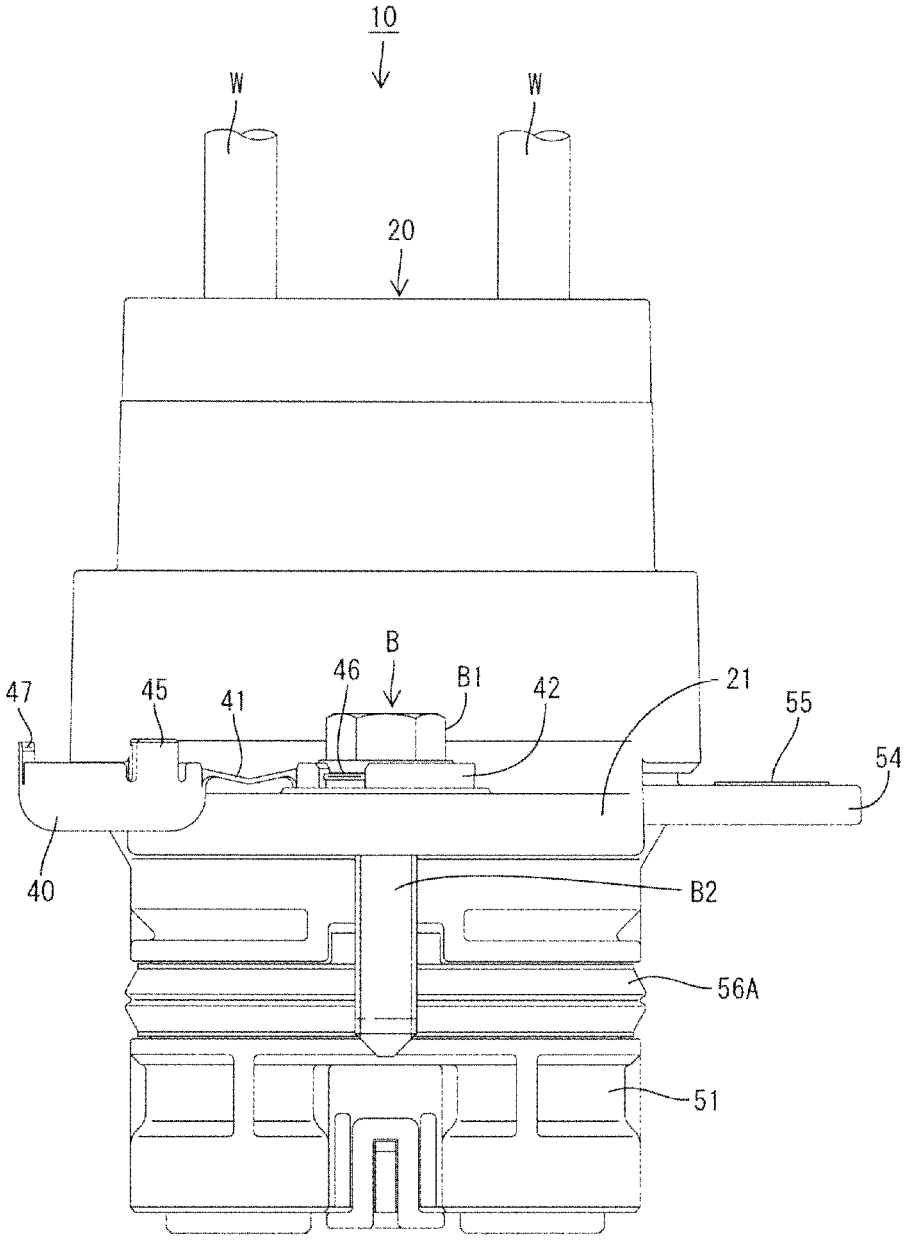
FIG. 4 is a front view showing a state before a bolt cap is mounted to cover a tightening portion.

The female housing 51 is wide and includes female cavities 53 for accommodating the female terminals 52. A fixing flange 54 projects laterally from an outer peripheral surface of the female housing 51, as shown in FIG. 4. A conductive metal collar 55 is formed integrally to the fixing flange 54. The fixing bolt (not shown) is inserted though the metal collar 55 and tightened into the fixing hole of the case C of the device. Thus, the fixing bolt firmly fixes the metal collar 55 to the case C of the device and mounts the female connector 50 to the case C of the device.

As shown in FIG. 3, a device-side fitting 50A of the female connector 50 is formed behind the fixing flange 54 and is fit into the mounting hole C1 of the case C of the device. On the other hand, a male-side fitting 50B of the female connector 50 is formed before the fixing flange 54 and projects from the outer surface of the case C of the device. The male-side fitting portion 50B can be fit into the male connector 10.

A first resilient rubber ring 56A is mounted on the outer peripheral surface of the device-side fitting 50A and is held in close contact with the outer peripheral surface of the device-side fitting 50A and the inner peripheral surface of the mounting hole C1. In this way, fluid- or liquid-tight sealing is provided between the case C of the device and the device-side fitting 50A to prevent entry of fluid (particularly water) into the interior of the case C of the device. A second resilient rubber ring 56B is mounted on the outer peripheral surface of the male-side fitting 50B and is held in close contact with the outer peripheral surface of the male-side fitting 50B and the inner peripheral surface of a shield shell 20. In this way, fluid- or liquid-tight sealing is provided between the male-side fitting 50B and the shield shell 20 to prevent entry of fluid (e.g. water) into the interior of the shield shell 20.

As shown in FIG. 2, the male connector 10 includes a male housing 11 made e.g. of synthetic resin and male terminals 12 accommodated in the male housing 11. The male housing 11 is wide and is formed internally with a terminal holding portion 13 in which the male terminals 12 are press-fit and held. The male terminals 12 are to be connected to an end of a shielded wire W and electrically conductively connected to the female terminal 52 as the two connectors 10, 50 are connected.

A third resilient rubber ring 14 is mounted on the outer peripheral surface of the male housing 11. As shown in FIG. 3, the third resilient rubber ring 14 is to be held in close contact with the outer peripheral surface of the male housing 11 and the inner peripheral surface of the male-side fitting 50B when the two connectors 10, 50 are connected properly. In this way, fluid-tight sealing is provided between the male and female housings 11 and 51 to prevent entry fluid (particularly water) into the interior of the female housing 51.

The male housing 11 is to be covered by the substantially tubular shield shell 20. This shield shell 20 is made of an electrically conductive material, such as metal, and, specifically, die-cast aluminum. A seat 21 projects radially out at the front opening edge of the shield shell 20 and an insertion hole 22 penetrates through the seat 21 in a plate thickness direction TD for receiving the bolt B. The tightening bolt B has a groove for receiving a C-ring 23 that retains the bolt B rotatably in the insertion hole 22 of the seat 21.

A mounting flange 15 is provided on the outer periphery of the male housing 11 and is positioned at a specified depth in the shield shell 20 of the male housing 11 by contacting a step 24 in the shield shell 20. Two mounting pieces 16, 16 extend back from the mounting flange and two mounting projections 25, 25 are provided in the shield shell 20 for engaging the mounting pieces 16, 16. Engagement of the mounting pieces 16, 16 with the mounting projections 25, 25 holds the male housing 11 in the shield shell 20.

A tightening portion B1 is arranged at one end of the bolt B and a substantially cylindrical shaft B2 projects in the axial direction AD from an axial center part of the tightening portion B1. A part of the shaft B2 accommodated in the insertion hole 22 has no external threads, as shown in FIG. 2, whereas a leading end of the shaft B2 before the C-ring 23 is formed with an external thread. Thus, the shaft B2 of the bolt B is screwed into the bolt hole C by tightening the tightening portion B1 e.g. using a tool.

Figure 8:
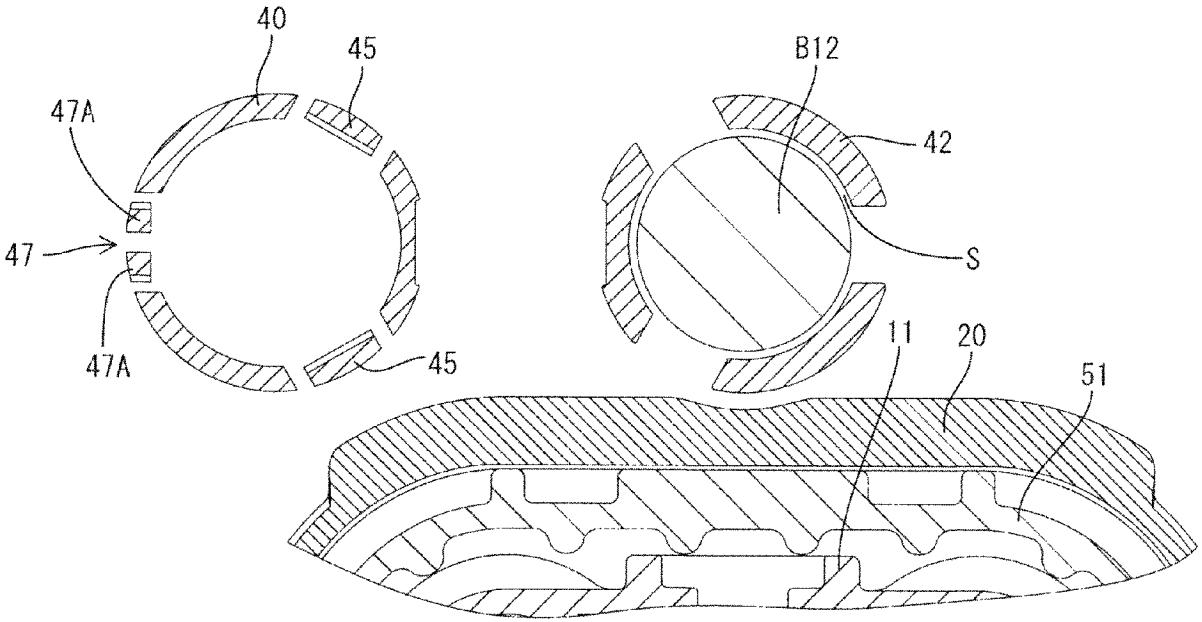
FIG. 8 is a section along A-A of FIG. 3 showing a structure for preventing rotation of the bolt cap.
Figure 9:
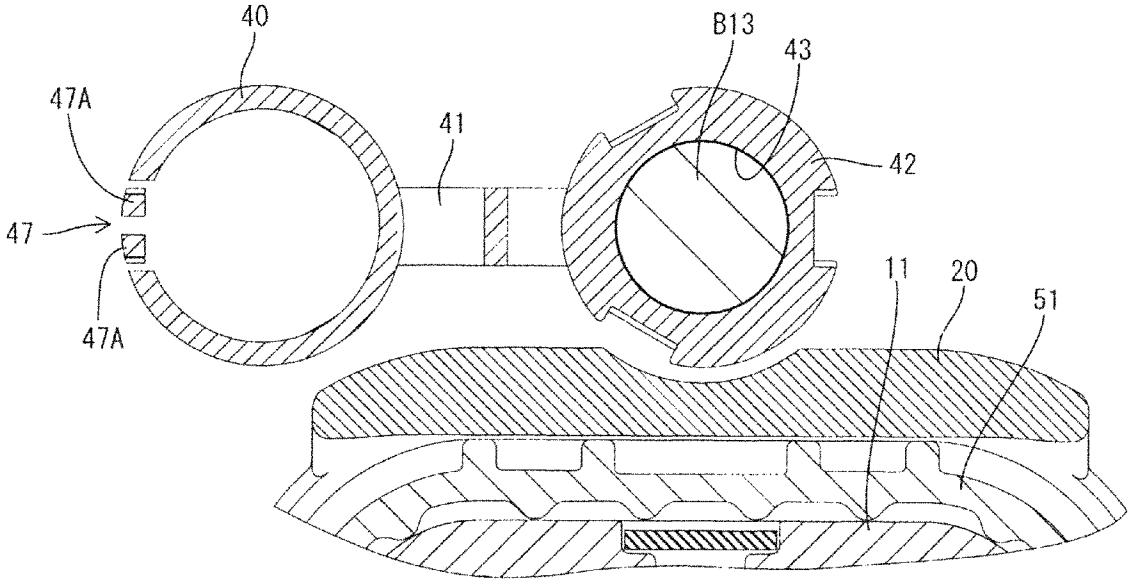
FIG. 9 is a section along B-B of FIG. 3 showing the structure for preventing rotation of the bolt cap.

More specifically, the tightening portion B1 comprises a head B11, a bolt flange B12 connected at the shaft B2 side of the head B11 and a small diameter portion B13 connected at the shaft B2 side of the bolt flange B12. The bolt flange B12 has a diameter larger than the head B11 and the small diameter portion B13. The head B11 is in the form of a column having a substantially right hexagonal cross-section. On the other hand, the bolt flange B12 and the small diameter portion B13 both have right circular cross-sectional shapes, as shown in FIGS. 8 and 9. A clearance S is set between the outer peripheral surface of the bolt flange B12 and the inner peripheral surface of a mounting portion 42, as shown in FIG. 8.

The tightening portion B1 is arranged behind the seat 21. The front surface of the small diameter portion B13 pushes the rear surface of the seat 21 forward in connecting direction CD by tightening the bolt B into the bolt hole C2 to bring the two connectors 10, 20 into a properly connected state. In this properly connected state, a clearance is set between the front surface of the bolt flange B12 and the rear surface of the seat 21 and a mounting recess D is formed by a wall surface forming this clearance. That is, the mounting recess D is formed by the bolt flange B12, the small diameter portion B13 and a rear edge of the insertion hole 22.

Figure 5:
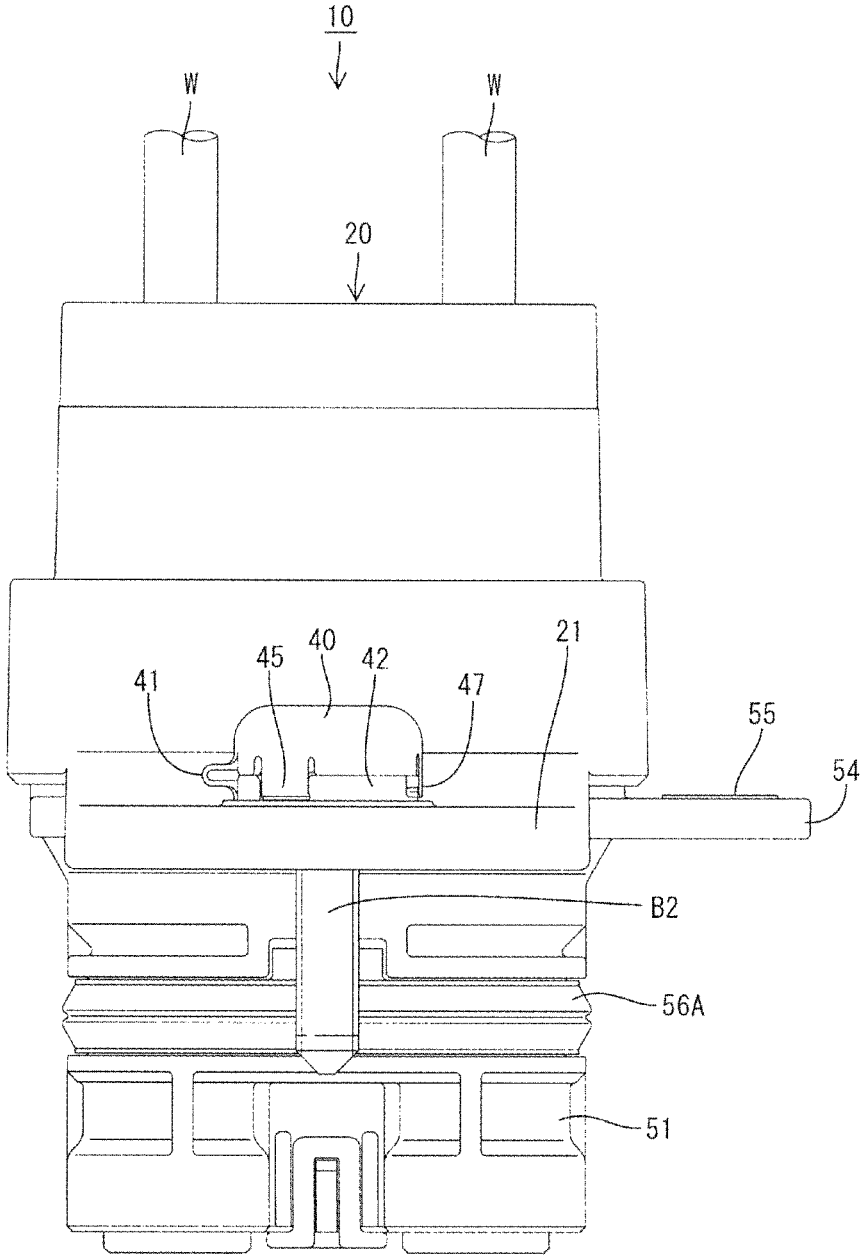
FIG. 5 is a front view showing the bolt cap mounted to cover the tightening portion.

As shown in FIGS. 4 and 5, a bolt cap 40 is connected to the mounting portion 42 via at least one flexible hinge 41 and is mountable on the tightening portion B1. As shown in FIG. 3, the mounting portion 42 is to be mounted in the mounting recess D. The mounting portion 42 includes a mounting projection 43 to be fit into the mounting recess D and a dimension of the mounting projection 43 is less than a dimension of the mounting recess D in forward and backward directions FBD. Thus, the mounting projection 43 is not held tightly in the mounting recess D even if the tightening bolt B is tightened into the bolt hole C2. The mounting projection 43 is to be fit into the mounting recess D and engaged therewith in forward and backward directions FBD to hold the mounting portion 42 in the mounting recess D.

Figure 10:
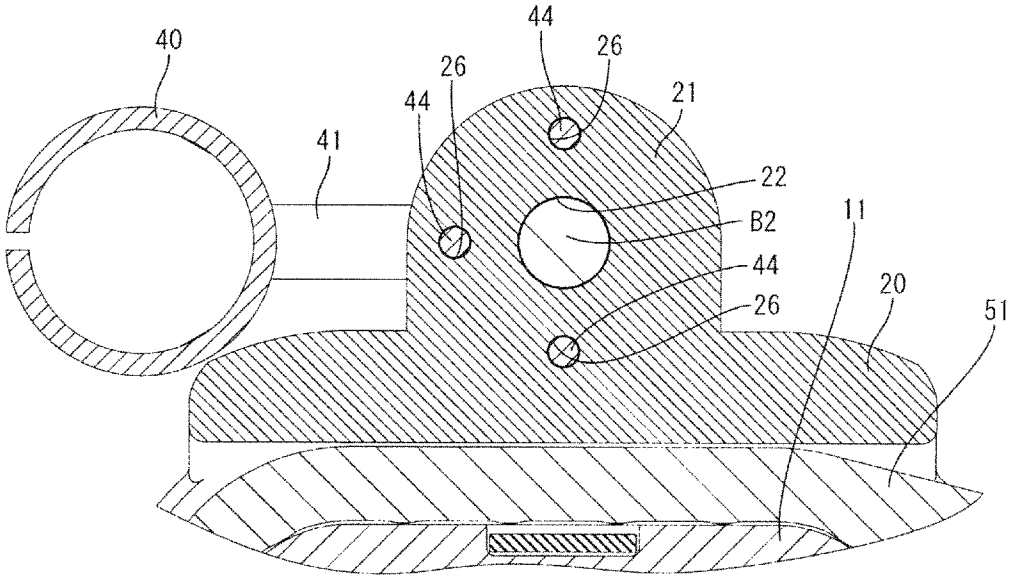
FIG. 10 is a section along C-C of FIG. 3 showing the structure for preventing rotation of the bolt cap.

The mounting portion 42 is formed with engaging projections 44, as shown in FIGS. 3 and 10. On the other hand, engaging recesses 26 are provided in a part of the seat 21 facing the mounting portion 42 for engaging the respective engaging projections 44 to prevent displacement or rotation of the mounting portion 42. Inner peripheral surfaces of the engaging recesses 26 contact with outer peripheral surfaces of the engaging projections 44 in a turning direction about an axis center of the insertion hole 22. In this way, the mounting portion 42 is prevented from rotating in the mounting recess D.

As shown in FIG. 10, the engaging projections 44 are columns of substantially circular cross-section and the engaging recesses 26 are holes of substantially circular cross-section. Specifically, three engaging projections 44 and three engaging recesses 26 are arranged concentrically around the axis center of the shaft B2. Further, two of the engaging projections 44 and the engaging recesses 26 are arranged at each of substantially opposite sides of the shaft portion B2 in a projecting direction of the mounting portion 42. The remaining engaging projection 44 and the engaging recess 26 are at a side closer to the bolt cap 40 than the shaft B2 in a direction perpendicular to the projecting direction of the mounting portion 42. Thus, the bolt cap 40 can be positioned in a normal mounting posture at the left side of the shaft B2 in FIG. 10. As a result, the bolt cap 40 cannot be mounted in an opposite posture at the right side of the shaft B2, thereby securing a space for bolt tightening using a tightening tool such as an impact wrench.

Figure 6:
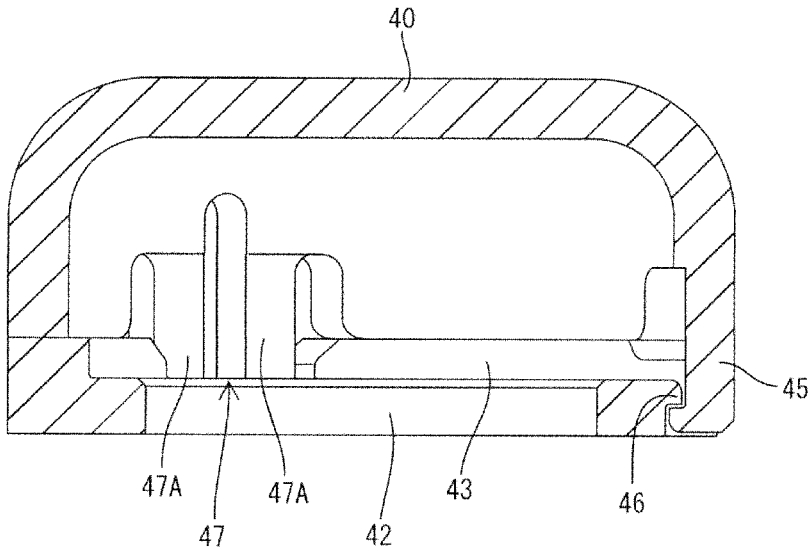
FIG. 6 is a section showing a locking structure for the bolt cap.
Figure 7:
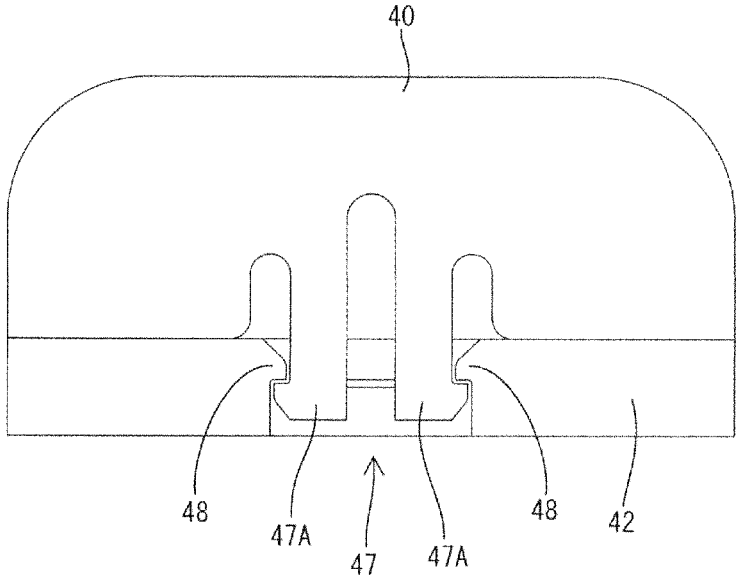
FIG. 7 is a side view showing the locking structure for the bolt cap.

The bolt cap 40 has locks that are engageable with the mounting portion 42. More particularly, first locks 45, 45 are arranged on the hinge 41 side and are engageable with a first engaging portion 46 on the mounting portion 42 from a radially outer side, as shown in FIG. 6. A second lock 47 faces the hinge 41 and includes two second locking pieces 47A, 47A, as shown in FIG. 7. The second locking pieces 47A, 47A are engageable with two second engaging portions 48, 48 on the mounting portion 42 from an inner side in the turning direction. The locks 45, 47 deform resiliently to move onto the corresponding engaging portions 46, 48 while the bolt cap 40 is being mounted to cover the tightening portion B1, and resiliently restore when the bolt cap 40 is mounted properly on the tightening portion B1. Both locks 45, 47 are locking pieces used to fix the bolt cap 40 to the mounting portion 42. However, a part of the mounting portion 42 near the hinge 41 may be lifted from the mounting portion 42 due to the rigidity (resilient restoring force) of the hinge 41 if it is tried to fix the bolt cap 40 to the mounting portion 42 only by the second lock 47. The first locks 45, 45 prevent such a lifting movement.

The male housing 11 initially is fit lightly into the female housing 51 by the hand to connect the male connector 10 to the female connector 50. The two connectors 10, 50 then are connected gradually by tightening the tightening bolt B into the bolt hole C2. The mounting portion 42 is retained in the mounting recess D in the axial direction AD and the turning direction so that the mounting portion 42 will not rotate with the tightening bolt B. The bolt cap 40 is mounted to cover the tightening portion B1 after the two connectors 10, 50 are connected properly. This can prevent the tightening portion B1 from being turned using a tool to separate the two connectors 10, 50. Thus, the bolt cap 40 can be held without increasing the number of parts.

As described above, the bolt cap 40 is locked in the axial direction AD with respect to the mounting portion 42 when the mounting portion 42 is mounted in the mounting recess D and the bolt cap 40 is mounted to cover the tightening portion B1 of the tightening bolt B. As a result, the bolt cap 40 can be held in a state covering the tightening portion B1 of the tightening bolt b. The mounting recess D is formed between the seating portion 21 and the bolt flange B12. Thus, it is not necessary to form the mounting recess D separately from the tightening bolt B and the bolt cap 40 and the bolt cap 40 can be held without increasing the number of parts.

The hinge enables the bolt cap 40 and the mounting portion 42 to be handled as an integral part even if the bolt cap 40 is removed from the tightening portion B1 of the tightening bolt B. Thus, the bolt cap 40 cannot be lost. Further, the shaft B2 of the tightening bolt B can be supported rotatably in the seat 21 by inserting the shaft B2 of the tightening bolt B into the insertion hole 22 and mounting the C-ring 23 on the shaft B2 of the tightening bolt B. Further, the engaging projections 44 of the mounting portion 42 are engaged with the engaging recesses 26 of the seat 21 to prevent rotation of the mounting portion 42 relative to the seat 21.

The invention is not limited to the above described embodiment. For example, the following embodiments are also included in the scope of the invention.

The bolt cap 40 and the mounting portion 42 are connected by the hinge 41 in the above embodiment. However, they may be separate or connected by any other means such as a wire, chain or the like.

The connector main body composed of the male housing 11 and the shield shell 20 is illustrated in the above embodiment. However, the connector main body may be composed only of a male housing and an insertion hole into which the tightening bolt B is to be inserted may be formed by a conductive (particularly metal) collar.

The engaging recesses 26 and the engaging projections 44 are provided in the above embodiment for preventing the rotation of the mounting portion 42. However, rotation of the mounting portion may be prevented by forming the mounting portion into a rectangular outer peripheral shape and forming the part of the seating portion for accommodating the mounting portion into a rectangular inner peripheral shape.

What is claimed is:

1. A device connector to be mounted and fixed to a device by a bolt in that has a tightening portion to be engaged by a tool to screw the bolt into a bolt hole in the device in an axial direction of the bolt hole, the device connector comprising:

a connector main body including an insertion hole into which the bolt is insertable in the axial direction;

a bolt cap to cover the tightening portion of the bolt;

a seat at a part of the connector main body adjacent the insertion hole to be sandwiched by an edge of the bolt hole and the tightening portion of the bolt in the axial direction;

a mounting recess between the seat and a bolt flange projecting from an outer peripheral side surface of the tightening portion of the bolt in a direction crossing the axial direction; and a mounting portion to be mounted in the mounting recess and engaged with the bolt cap in the axial direction for holding the bolt cap covering the tightening portion of the bolt.

2. The device connector of claim 1, wherein the bolt cap and the mounting portion are connected via at least one flexible hinge.

3. The device connector of claim 1, further comprising a holder mounted on a shaft of the bolt inserted through the insertion hole and disposed on a side of the seat opposite the tightening portion.

4. The device connector of claim 1, wherein the connector main body includes a housing made of resin and a shield made of a conductive material and substantially covering the housing, the seat being on the shield.

5. The device connector of claim 1, wherein the mounting portion includes at least one engaging portion and the seat includes at least one engageable portion engaged with the engaging portion to prevent rotation of the mounting portion.

6. The device connector of claim 1, further comprising a resilient member mounted on an outer peripheral surface of the connector main body for closely contacting the connector main body and a portion of a mating connector when the device connector is connected properly to the mating connector to provide fluid-tight sealing between the connector main body and a mating housing of the mating connector.

7. A device connection system comprising:

the device connector of claim 1 to be mounted and fixed to a device, and a bolt including a tightening portion to be tightened using a tool in screwing the bolt into a bolt hole provided in the device in an axial direction of the bolt hole.

8. The device connection system of claim 7, wherein the tightening portion comprises a head, a flange projecting out from an axial end of the head, a small diameter portion extending axially from the axial end of the head and a shaft projecting axially from the small diameter portion, wherein the flange has a larger diameter than the head and the small diameter portion.

9. The device connection system of claim 8, wherein the head is a column having a substantially right hexagonal cross-section and wherein the flange and the small diameter portion have right circular cross-sectional shapes.

10. The device connection system of claim 8, wherein a clearance is set between a front surface of the flange and a rear surface of the seat and the mounting recess is formed by a surface forming this clearance.

11. A device connector to be mounted and fixed to a device that has a bolt hole extending in an axial direction, the device connector comprising:

a connector main body including an insertion hole that can be aligned with the bolt hole, a seat at a part of the connector main body adjacent the insertion hole;

a bolt having opposite first and second ends, a tightening portion at the first end and configured to be engaged by a tool to rotate the bolt, a flange projecting out from an outer peripheral side surface of the tightening portion at a part of the tightening portion closest to the second end, a shaft at the second end and configured to be passed through the insertion hole of the connector main body and screwed into the bolt hole of the device;

a mounting recess between the seat and the flange;

a mounting portion mounted in the mounting recess; and a bolt cap movably connected to the mounting portion and configured to cover the tightening portion of the bolt.

12. The device connector of claim 11, wherein the bolt cap and the mounting portion are connected unitarily via at least one flexible hinge.

13. The device connector of claim 11, further comprising a C-ring holder mounted on a shaft of the bolt inserted through the insertion hole and disposed on a side of the seat opposite the tightening portion for holding the bolt in the insertion hole of the connector main body.

14. The device connector of claim 11, wherein the connector main body includes a housing made of resin and a shield made of a conductive material and substantially covering the housing, the seat being on the shield.

15. The device connector of claim 11, wherein the mounting portion includes at least one engaging portion and the seat includes at least one engageable portion engaged with the engaging portion to prevent rotation of the mounting portion.

* * * * *